US008376199B2

(12) United States Patent
Ellis

(10) Patent No.: US 8,376,199 B2
(45) Date of Patent: Feb. 19, 2013

(54) MULTI-FUNCTION TOOL ASSEMBLY

(76) Inventor: Jameson Ellis, Sag Harbor, NY (US)

( * ) Notice: Subject to any disclaimer, the term of this patent is extended or adjusted under 35 U.S.C. 154(b) by 505 days.

(21) Appl. No.: 12/544,613

(22) Filed: Aug. 20, 2009

(65) Prior Publication Data

US 2011/0041256 A1 Feb. 24, 2011

(51) Int. Cl.
*A44B 11/00* (2006.01)

(52) U.S. Cl. ..... 224/163; 7/127; 7/128; 224/904

(58) Field of Classification Search ..... 224/163, 224/182, 904, 660, 667, 672, 240, 195, 232, 224/245, 269, 914; 7/128, 168, 127, 170, 7/142; D3/228; 24/163 K; D11/200, 201; 2/322; 206/234; 30/155, 151
See application file for complete search history.

(56) References Cited

U.S. PATENT DOCUMENTS

| | | | | | |
|---|---|---|---|---|---|
| 3,103,047 | A | * | 9/1963 | Wolf, Jr. | 24/376 |
| 4,078,272 | A | | 3/1978 | Mahon, III | |
| 4,096,979 | A | | 6/1978 | Collins | |
| 4,260,087 | A | | 4/1981 | Leaver | |
| 4,377,249 | A | | 3/1983 | Bockoven | |
| 4,389,775 | A | | 6/1983 | Collins | |
| 4,466,561 | A | | 8/1984 | Slaughter | |
| 4,481,712 | A | * | 11/1984 | Phelps | 30/151 |
| 4,529,111 | A | | 7/1985 | Hayakawa | |
| 4,570,308 | A | * | 2/1986 | Weisgerber | 24/163 K |
| 4,676,420 | A | * | 6/1987 | Sharp | 224/271 |
| 4,747,165 | A | | 5/1988 | Limbach | |
| 4,753,377 | A | | 6/1988 | Poluhowich | |
| 4,807,362 | A | * | 2/1989 | Prentice | 30/155 |
| 4,836,425 | A | * | 6/1989 | McClellan | 224/163 |
| 4,955,097 | A | | 9/1990 | Roderer | |
| 5,217,150 | A | | 6/1993 | Chen | |
| 5,609,280 | A | * | 3/1997 | Smith | 224/163 |
| 5,609,281 | A | | 3/1997 | West | |
| D488,367 | S | | 4/2004 | Ping | |
| D491,439 | S | | 6/2004 | Ping | |
| D493,346 | S | | 7/2004 | Ping | |
| 6,763,543 | B2 | | 7/2004 | Rivera | |
| D502,856 | S | | 3/2005 | Ping | |
| 6,889,879 | B2 | | 5/2005 | Rivera et al. | |
| D509,125 | S | | 9/2005 | Ping | |
| 6,957,466 | B2 | | 10/2005 | Rivera | |
| 6,990,702 | B2 | | 1/2006 | Rivera | |
| 7,146,668 | B2 | | 12/2006 | Rivera | |
| 7,150,210 | B2 | | 12/2006 | Berg et al. | |
| 7,204,022 | B2 | | 4/2007 | Tsuda | |
| 2004/0255731 | A1 | | 12/2004 | Berg et al. | |
| 2005/0177954 | A1 | | 8/2005 | Smith | |
| 2006/0253995 | A1 | | 11/2006 | Berg et al. | |
| 2007/0157771 | A1 | | 7/2007 | Rivera | |
| 2007/0199156 | A1 | | 8/2007 | Yale et al. | |

* cited by examiner

*Primary Examiner* — Nathan J Newhouse
*Assistant Examiner* — Matthew Theis
(74) *Attorney, Agent, or Firm* — Jeffrey Sonnabend; SonnabendLaw

(57) ABSTRACT

A multi-function tool assembly for coupling with a users belt including a belt attachment apparatus detachably engaged with a multi-function tool. The belt attachment apparatus includes coupling structure for coupling with a user's belt and engagement structure for detachably engaging the multi-function tool. The multi-function tool is provided with belt attachment engagement structure on its rear surface for detachably engaging the engagement structure of the belt attachment apparatus.

7 Claims, 9 Drawing Sheets

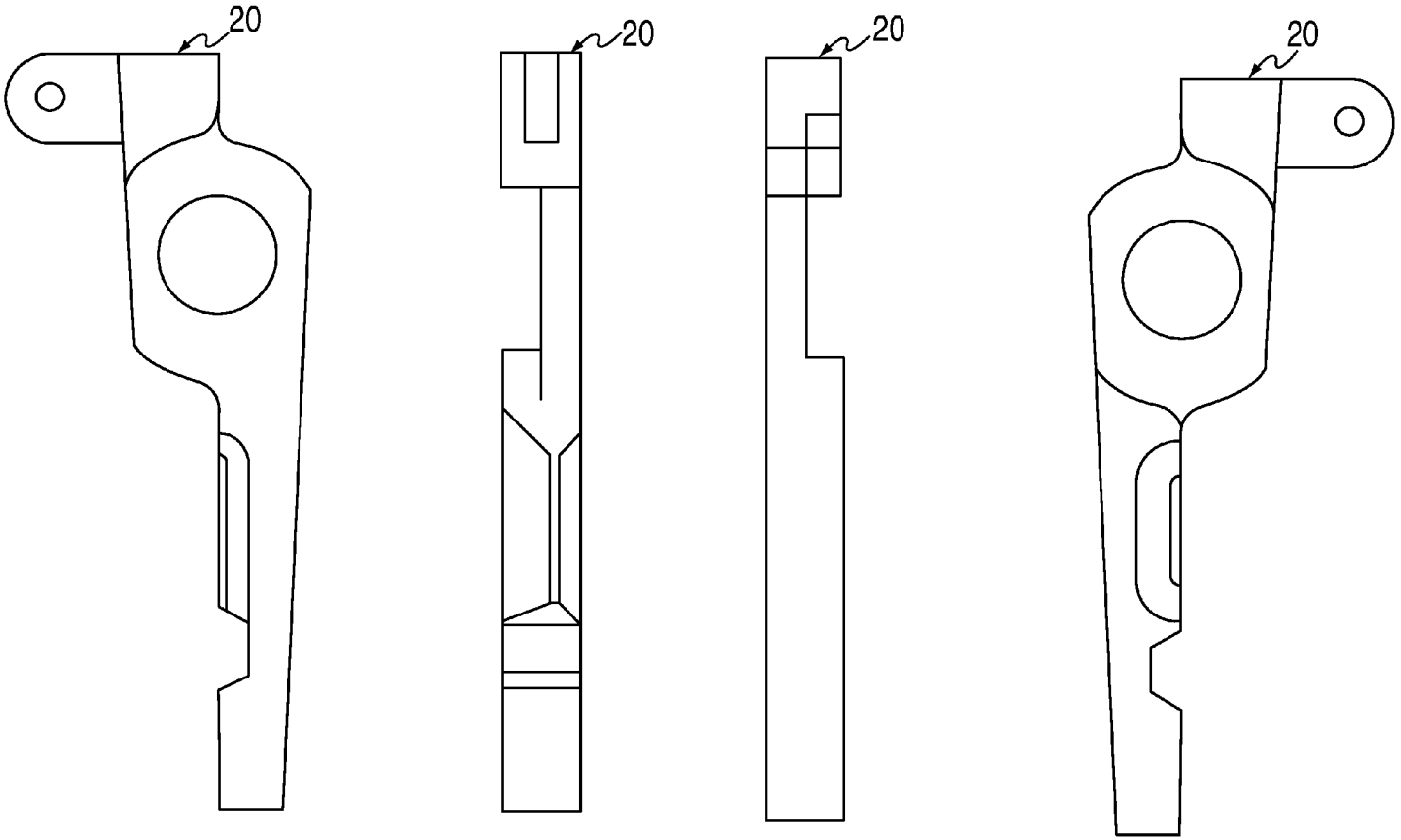
FIG. 10a
FIG. 10b
FIG. 10c
FIG. 10d
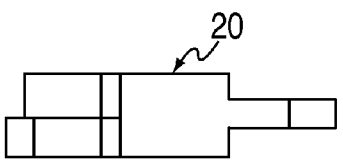
FIG. 10e
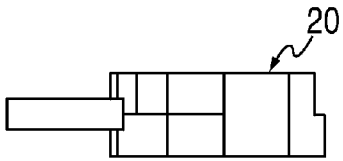
FIG. 10f

MULTI-FUNCTION TOOL ASSEMBLY

FIELD OF THE INVENTION

The present invention relates to hand tools and more particularly to a multi-function tool assembly that detachably engages a multi-function tool with a user's belt.

BACKGROUND OF THE INVENTIONS

Multi-function tools are well known. In typical multi-function tools, pliers and other selected tools, such as screwdrivers, knife blades, files, etc., are provided in a single tool. Known multi-function tools often include pliers and have channel-shaped handles pivotally connected to the pliers' jaw members. Typically, the handles fold over so that the pliers are received in the channel-shaped handles. Also, the other tools fold over and are received in the channel-shaped handles as well.

The common element among such pliers-like tools is that each includes a pair of opposing jaws operated by a pair of opposing handles. It is understood that when the handles of such a jaw/handle combination store one or more tools, the entire device is then referred to as multi-function tool.

Such tools are typically stored in a pocket formed in one or both of the handle members. Examples of tools found in multi-tool handles include knife blades, can openers, screwdrivers, files, scissors, saw blades and the like. These tools fold into and out of the handle of the multi-tool, similar to a knife blade folding into and out of a pocket knife. Multi-tools often include other tools that do not fold, such as a ruler stamped into an exposed surface of one or both handles of the multi-function tool.

In order to store such multi-tools, various sheaths, pouches, holsters and other types of carriers are well-known for keeping multipurpose tools on a user's belt where they are disposed therein and are readily available for use. Some such useful articles are considered as a status symbols when carried in a visible location and can be a factor in determining which such multi-function tool is purchased instead of another.

However, such sheaths and other carriers are intended to carry a multi-function tool in a familiar location on a user, where the multi-function tool is easily and quickly available for use, and where the multi-function tool can be replaced easily enough that one is not tempted to set it down and thus risk leaving it behind and losing it.

While many previously available carriers and sheaths have included clips or arms that can be slipped over the top of a person's belt or be removed from the belt while it is being worn. Such clips, however, have not been able to fasten a carrier to a belt as securely as is desired, particularly when a carrier is to be used to carry an expensive multi-function tool or one which might be damaged if it falls.

Various sheaths for articles such as pagers or wireless telephones are not capable of securely and dependably holding heavier articles securely without the use of latches or flaps that must be unfastened and re-fastened in order to use and replace the article being carried and such an additional step required for use of such carriers may be enough to tempt a person using such a carrier to lay down an expensive multi-function tool or other article, rather than immediately replacing it into the carrier, with the result that the multi-function tool or other article is eventually left behind and lost.

Many sheaths, although secure, strong, easily used and good looking, such as some pouches or sheaths made of leather, are undesirably costly to produce and do not long maintain their good appearance in everyday use.

SUMMARY OF THE INVENTION

The present invention provides a multi-function tool assembly which couples with a users belt. The multi function tool assembly includes a multi-function tool detachably engaged with a belt attachment apparatus.

The multi-function tool is moveable between an open position and a closed position and has opposing front and rear surfaces. The multi-function tool preferably includes a jaw-type tool having first and second elongate jaw members interconnected with each other by a pivot pin assembly. First and second handle members are pivotally connected respectively to the first and second jaw members such that when the multi-function tool is in its closed position, the first and second elongate jaw members are substantially parallel and adjacent to one another and the handle members are substantially parallel and spaced apart from one another at a distance approximately equal to the width of the parallel and adjacent first and second elongate jaw members. The rear surface of the multi-function tool includes engagement structure for detachably engaging the belt attachment apparatus.

The belt attachment apparatus is configured to couple with a user's belt for detachably engaging the multi-function tool thereto. The belt attachment apparatus includes an elongate body member having opposing first and second ends and an upstanding boss member provided in close proximity to the second end of the elongate body member configured to receive within a belt hole on a user's belt. An elongate rod member extends substantially parallel from the second end of the elongate body member and is spaced therefrom to receive a user's belt strap therebetween. Also provided is engagement structure on the elongate body member configured to detachably engage the engagement structure on the multi-function tool.

BRIEF DESCRIPTION OF THE DRAWINGS

The objects and features of the invention may be understood with reference to the following detailed description of an illustrative embodiment of the invention taken together with the accompanying drawing in which:

FIGS. 10A-F are elevational views of a first elongate jaw member, specifically, 10A is a rear elevational view, 10B is a front elevational view, 10C is a right side elevational view, 10D is a left side elevational view, 10E is a first end elevational view and 10F is a second end elevational view;

DETAILED DESCRIPTION

Figure 1:
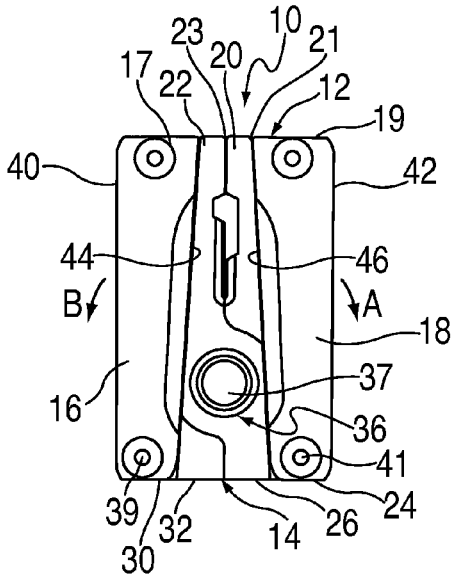
FIG. 1 is a top planer view of an illustrated embodiment of the multi-function tool of the present invention in a closed position.
Figure 5A:
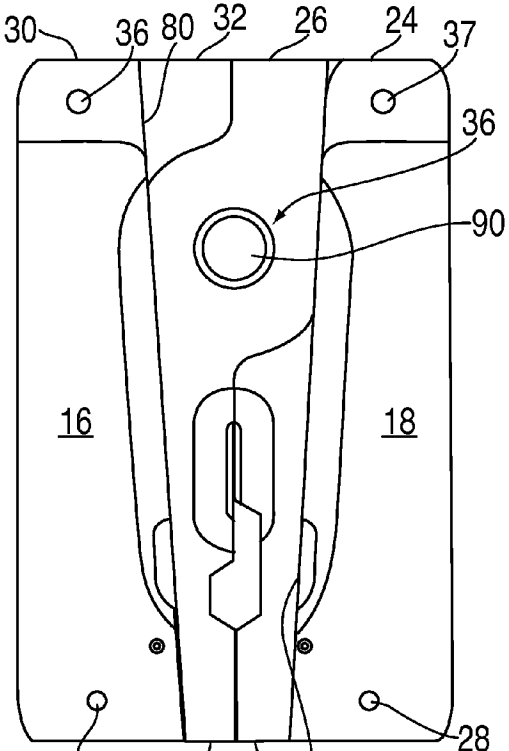
FIGS. 5A-D are elevational views of the multi-function tool in a closed position, specifically, 5A is a rear elevational view; 5B is a first end elevational view; 5C is a second end elevational view and 5D is a left side elevational view.
Figure 5C:
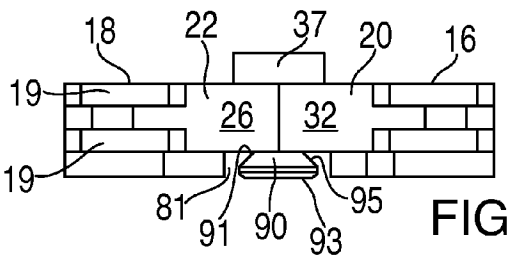
Figure 5D:
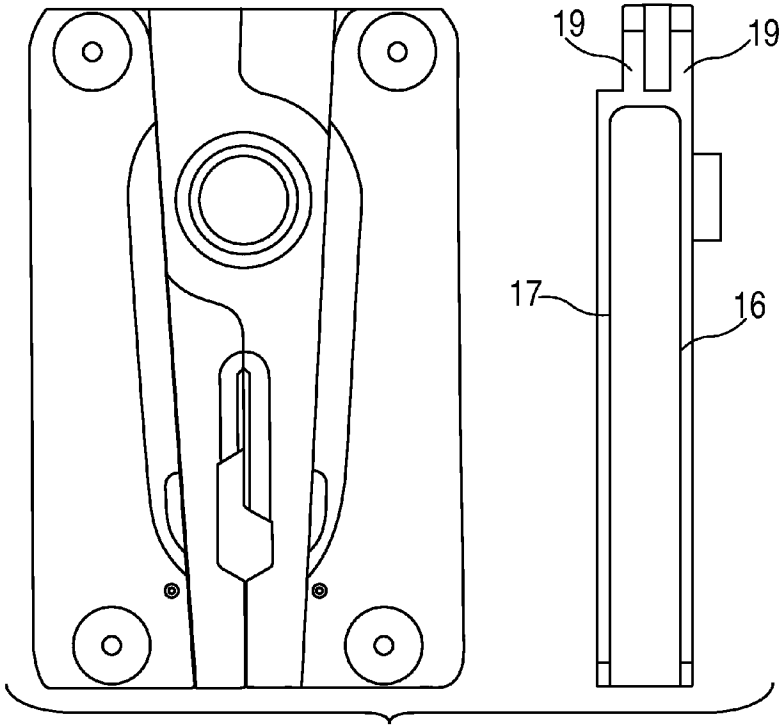
Figure 5B:
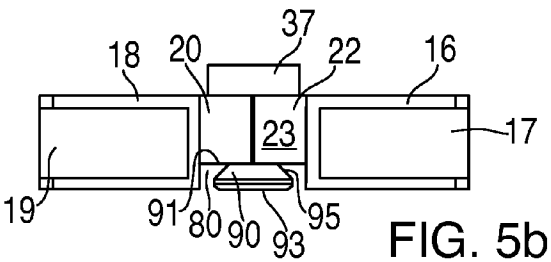

Turning now descriptively to the drawings, in which similar reference characters denote similar elements throughout the several views, FIG. 1 shows a folding multi-tool 10 according to an illustrated embodiment of the invention. It is to be appreciated that while FIG. 1 depicts a top view of the illustrated multi-tool 10 in accordance with the invention, FIGS. 5A-D depict corresponding views of this illustrated embodiment, specifically FIG. 5A shows a bottom view, FIG. 5B shows a front side view, FIG. 5C shows a back side view and FIG. 5D shows a left side view.

Figure 2:
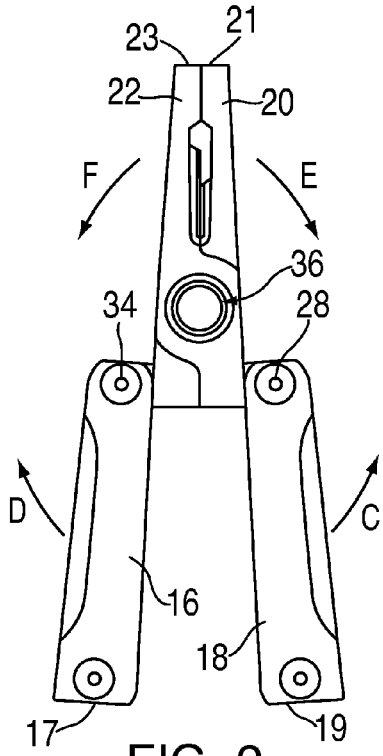
FIG. 2 is a top planer view of the multi-function tool in an open position.

The folding multi-tool 10 depicted in FIG. 1 is shown in a closed, compact configuration, such as would be used for storing on a the users belt, via belt buckle attachment apparatus 100, which will also be described below. FIG. 2 shows the folding multi-tool 10 in open position. With reference to FIG. 1, the folding multi-tool 10 has a front surface and an opposing rear surface having a first end 14 and an opposing second end 12.

The folding multi-tool 10 includes first and second channel-shaped handle members 16 and 18 (FIGS. 11A-D). Each of the channel-shaped handle members 16 and 18 is respectively coupled to a respective pliers member 20 and 22. For instance, handle member 16 is pivotally coupled to pliers member 20 (FIGS. 10A-F) while handle member 18 is pivotally coupled to pliers member 22 (FIGS. 9A-F). As shown in FIGS. 1 and 2, a first end 24 of handle member 18 is pivotally coupled to a first end 26 of pliers member 22 preferably by a bolt/pivot pin assembly 28. Likewise, a first end 30 of handle member 16 is pivotally coupled to a first end 30 of pliers member 20 preferably by a like bolt/pivot assembly 34.

In proximity to the first end 26, 28 of each first and second pliers member 20, 22, a pivot pin assembly 36 is provided to secure each first and second pliers member 20, 22 to one another and to act as a pivot axle to allow the first and second pliers members 20 and 22 to be pivoted (e.g., open and close) relative to each other. Thus, pivot pin assembly 36 enables the first and second pliers members 20 and 22 to pivot towards and away from one another by a user when the multi-tool 10 is in its open configuration (FIG. 2). Pivot pin assembly 36 preferably includes a locking nut member 37 extending upward from the top surface the multi-tool 10 which secures to one end of the pivot pin and belt clipping member 90 secured to the opposing end of the pivot pin, which belt clipping member 90 extends downward from the bottom surface of the multi-tool 10 (FIG. 5B). As shown in FIGS. 5B and C, belt clipping member 90 is formed with a first end 91 preferably having a circular body with a first diameter adjacent the bottom surface of multi-tool 10 and an opposing second end 93 having a second diameter which is larger than the first diameter of the first end 91. Thus, belt clipping member 90 has a generally V-shaped body portion 95 extending between its first 91 and second ends 93.

With continuing reference to FIG. 5B, belt clipping member 90 is preferably extends from a V-shaped channel 80 formed between handle members 16 and 18. V-shaped channel 80 is defined by the height of the handle members 16 and 18 being greater than the height of the pliers members 20 and 22 disposed therebetween when the multi-tool 10 is positioned in its closed configuration (FIG. 1 and FIGS. 5A-D). Hence, belt clipping member 90 is preferably formed to have a generally conical configuration.

To manipulate the multi-tool 10 from its closed configuration (FIG. 1) to its open configuration (FIG. 2), a user pivots handle members 16 and 18 about their respective pivot pin assemblies 39 and 41 in the respective directions of arrows "A" and "B" as depicted in FIG. 1. A user continues said movement of each handle member 16 and 18 until the longitudinal axis of each handle member 16 and 18 is approximately parallel with the longitudinal axis of its coupled pliers member 20 and 22 as depicted in FIG. 2.

Figure 3:
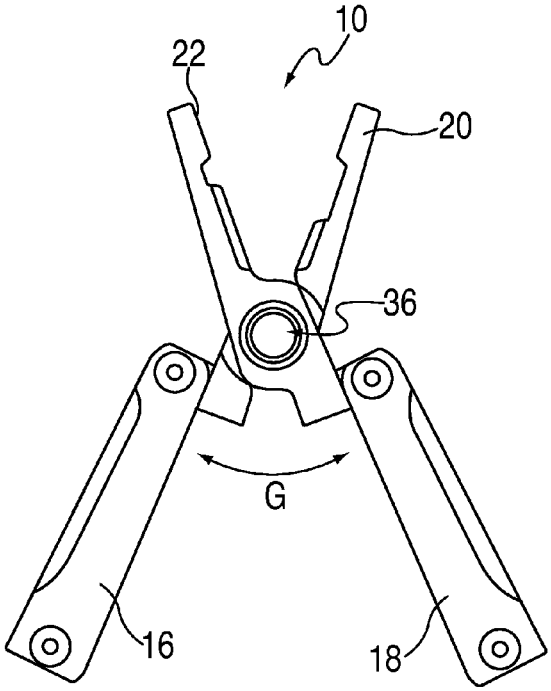
FIG. 3 is a top planer view of the multi-function tool in an open position with its handle members and jaw members extended away from each other.

Preferably, a locking mechanism is provided in the first end portion 24, 30 of each handle member 16 and 18 configured and operative to lock the handle member 16, 18 in the open position shown in FIG. 2 enabling operation of pliers members 20 and 22 whereby a user pivots, via pivot assembly 41, handle member 18 in the direction of arrow "C" and handle member 16, via pivot assembly 39, in the direction of arrow "D" to cause corresponding movement of pliers member 20 in the direction of arrow "E" and movement of pliers member 22 in the direction of arrow "F". Thus reciprocating movement of handle members 16 and 18 along arrow "G" depicted in FIG. 3 enables corresponding opening and closing of the pliers members 20 and 22 for operation thereof.

When it is desired to position multi-tool 10 back to its closed position (FIG. 1), the user positions the pliers members 20 and 22 to be in a closed position as depicted in FIG. 2, and then preferably unlocks the aforesaid locking mechanism provided in the first end portion 24, 30 of each handle member 16 and 18 so as to enable handle members 16 and 18 to again pivot about their respective pivot pin assemblies 39 and 41 in the respective directions of arrows "C" and "D" as depicted in FIG. 2. This movement of handle members 16 and 18 is continued until the second end 17 of handle member 16 is adjacent the second end 23 of pliers member 22, and likewise, the second end 19 of handle member 18 is adjacent the second end 21 of pliers member 20, as depicted in FIG. 1.

With continuing reference to FIG. 1, when the multi-tool 10 is in its closed position, the pliers members 20 and 22 are disposed intermediate, and co-planer with, respective adjacent handle members 18 and 16. This is in contrast to known prior art multi-tool devices wherein the pliers members are disposed within the inner channel portion defined in the handle members when the multi-tool assembly is positioned in a closed and transportable configuration.

Figure 4:
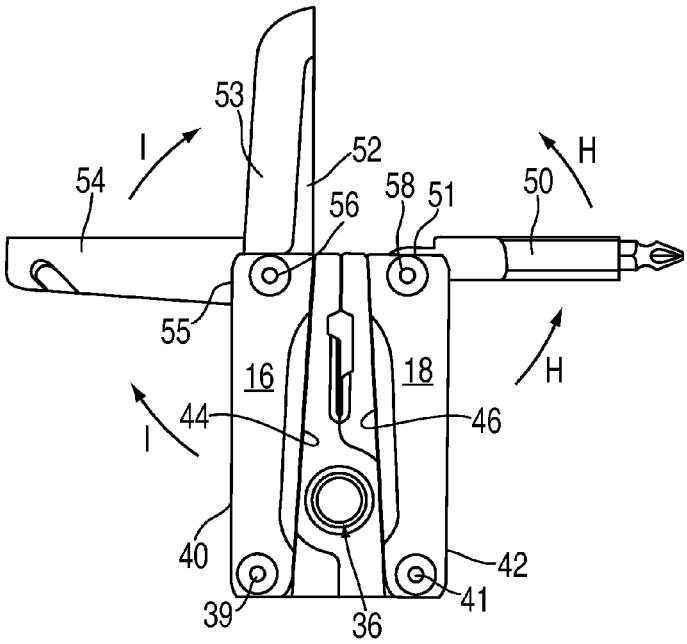
FIG. 4 is a top planer view of the multi-function tool in a closed position depicting tool members extending therefrom.

With reference now to FIG. 4, each handle member 16 and 18 has a generally C-shaped internal cross-section defining an open side portion 40, 42 and an opposing closed side wall 44, 46. In the present illustrated embodiment, and when in a closed configuration, the closed side wall 44, 46 of each handle member 16 and 18 is respectively disposed adjacent pliers members 22 and 20 while the open side portions 40 and 42 are outwardly facing as best shown in FIGS. 1 and 4. Each closed side wall 44 and 46 is preferably configured to have a curved configuration so as to comfortably fit the handle members 16, 18 in the confines of a users hand when multi-tool 10 is positioned in the open position (FIG. 2) to enable comfortable operation of the pliers members 20, 22.

Figure 12A:
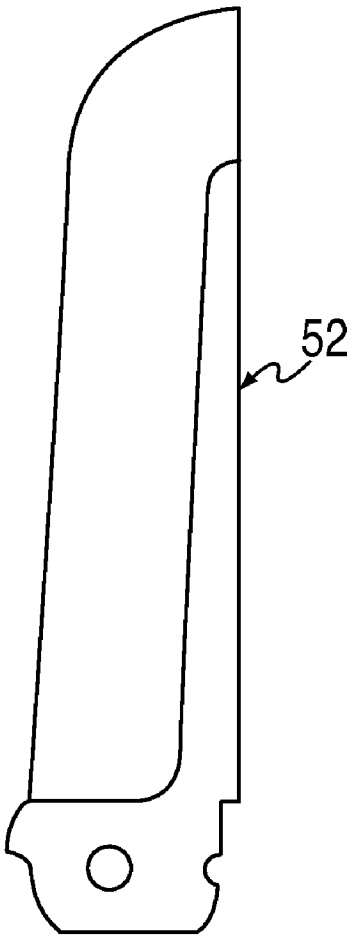
FIGS. 12A and B are elevational views of the tool members provided in the multi-function tool of FIG. 1, specifically, 12A is a front elevational view of a knife member and 12B is a front elevational view of a saw member.
Figure 12B:
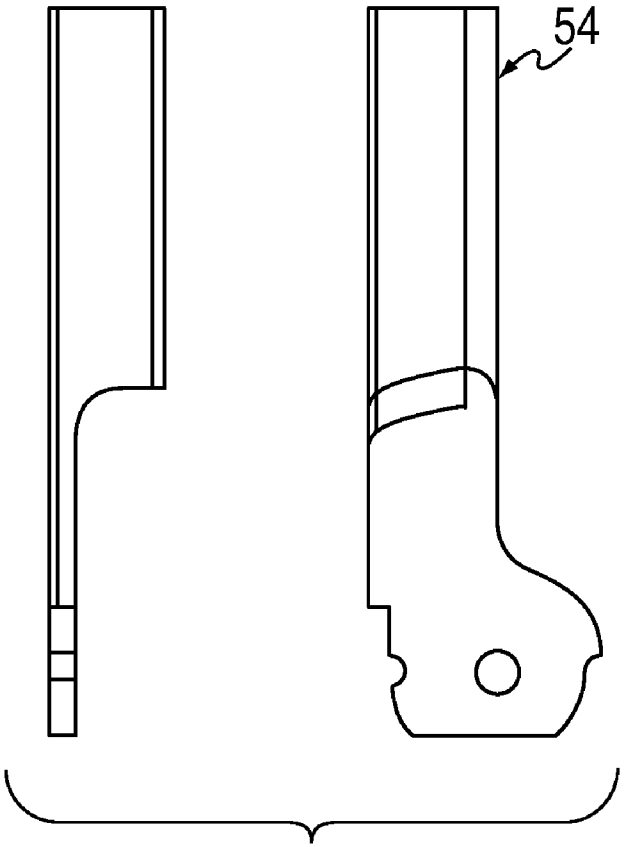

Pivotally disposed within the generally C-shaped internal cross section of each handle member 16 and 18 are various tools (e.g., screw drivers, knifes, saws, scissors, file and the like). For instance, and with reference to FIG. 4, handle member 18 is shown to include a pivotally attached screw driver tool 50, while handle member 16 is shown to include a pivotally attached knife tool 52 (FIG. 12A) and saw tool 54 (FIG. 12B). Proximal to the second end 17, 18 of each handle member 16 and 18, a pivot pin assembly 56 and 58 is provided each being configured and operative to reciprocate a tool member proximal and distal from the C-shaped internal cross section of each handle member 16 and 18. For instance, pivot pin assembly 58 provided on the second end 19 of handle member 18 is pivotally coupled to a proximal end 51 of the screw driver tool 51 such that by continued movement along arrow "H" a user can pivot the screw driver tool 50 outwardly from within the C-shaped internal cross section of handle member 18 into a position suitable for use thereof. Once the intended operation of screw driver tool 50 is completed, the user pivots the screw driver tool 50 inwardly back to within the C-shaped internal cross section of handle member 18 so as to preferably be wholly disposed therein as depicted in FIG. 1.

Likewise, pivot pin assembly 56 provided on the second end 17 of handle member 16 is pivotally coupled to the proximal ends 53, 55 of the knife 52 and saw tools 54, whereby the knife 52 and saw tools 54 are disposed in overlapping fashion to one another. A user may select either the knife 52 or saw 54 tool from the C-shaped internal cross section of handle member 16 such that by continued movement along arrow "I" a user can pivot the selected tool (knife 52 or saw 54) outwardly from within the C-shaped internal cross section of handle member 16 and into a position suitable for use thereof. Once the intended operation of the aforesaid selected tool (knife 52 or saw 54) is completed, the user pivots the selected tool (knife 52 or saw 54) inwardly towards the C-shaped internal cross section of handle member 16 so as to preferably be wholly disposed therein as depicted in FIG. 1.

With the illustrated embodiment of the aforesaid multi-tool 10 described above, discussion now turns to an illustrated embodiment of the belt attachment apparatus, designated generally by reference numeral 100, to which multi-tool 10 detachably engages with.

With reference now to FIGS. 6A-D, belt attachment apparatus 100 has a generally T-shaped configured body portion and is provided with a front surface 102 (FIG. 6A) and an opposing rear surface 104 (FIG. 6B) and opposing first and second ends 101, 103. The T-shaped configured body consists of a first elongated body member 106 substantially extending perpendicular from a second elongated body member 108. The first elongated body member 106 has a V-shaped configuration configured to slidably receive within the V-shaped channel 80 of multi-tool 10, as to be further discussed below. First elongated body member 106 also is provided with an elongated cutout portion 110 having first 112 and second 14 ends extending intermediate the first 101 and second 103 ends of the attachment member 100. The second end 114 of cutout portion 110 is formed with a diameter larger than the first end diameter 91 of the belt clipping member 90 but smaller than its second 93 while the first end 112 of cutout portion 110 is formed with a diameter larger than the second end 93 of the belt clipping member 90 so as to receive therewithin. The elongate channel portion of elongate cutout portion 110 extending between its first 112 and second ends 114 has a width "M" that is substantially equal to the diameter of the second end 114.

The second elongate body member 108 of attachment member 100 has opposing first 109 and second 111 ends each having upstanding flange members 120, 122 extending upwardly from the front surface 102 of attachment member 100. Coupled to and extending between each flange member 120, 122 is a belt securing rod 124 at a spaced distance from the front surface of the second elongated body member 108 of attachment member 100. The spaced distance between the belt securing rod 124 and the front surface of the second elongated body member 108 is configured to receive a user's belt strap.

Figure 6C:
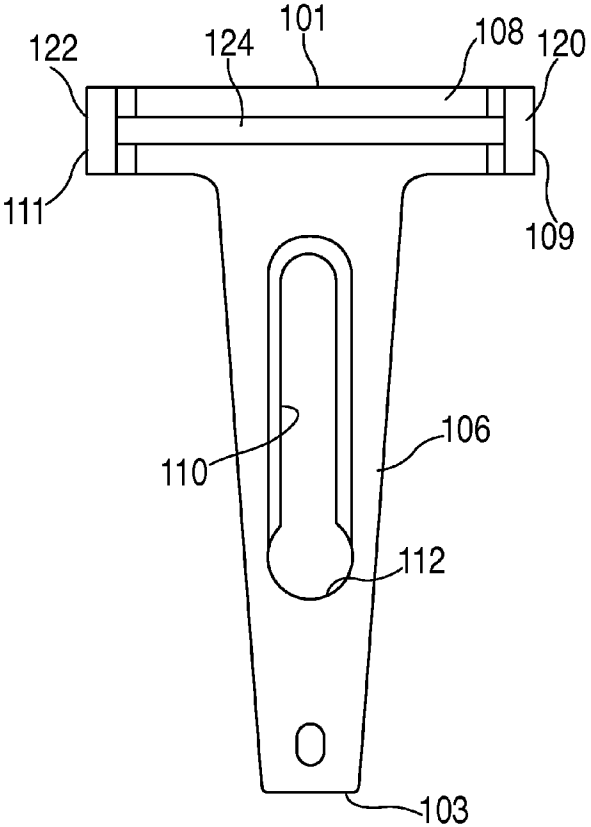
FIGS. 6A-C are elevational views of an illustrated embodiment of belt attachment apparatus, specifically, 6A is a top elevational view; 6B is a side elevational view; 6C is a rear elevational view, 6D is a front elevational view and 6E is a rear elevational view.
Figure 6B:
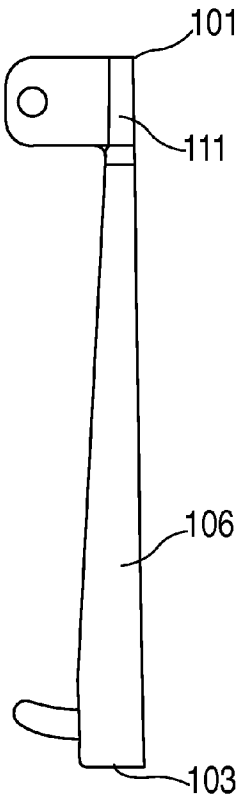
Figure 6A:
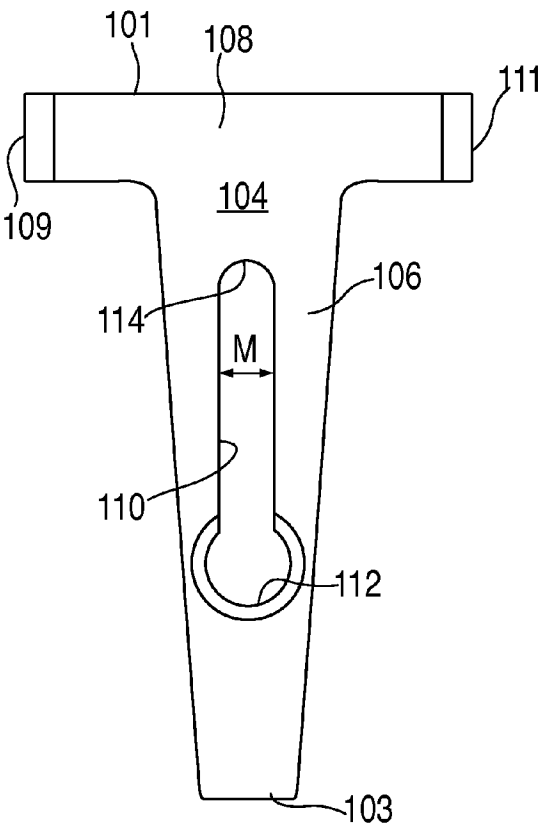

As best shown in FIG. 6B, to further secure belt attachment apparatus 100 to a users belt, a curved boss member 130 extends upwardly from the second end 103 of belt attachment apparatus 100. The curved boss member 130 is configured to secure within a belt hole provided on a user's belt.

Thus, to secure belt attachment apparatus 100 to a user's belt, the free end of a belt (of which the opposing end typically is provide with a belt buckle) is received within the securing space provided between the belt securing rod 124 and the front surface 102 at the first end 101 of the attachment member 100 such that the boss member 130 is then received within an open buckle hole provided on the user's belt for detachably securing the belt attachment apparatus 100 to a user's belt.

With the belt attachment apparatus 100, and its attachment to a user's belt, being described above, discussion will now turn to the detachable engagement of multi-function tool 10 with belt attachment apparatus 100.

With reference now to FIGS. 7A-D, a user first receives the belt clipping member 90 of multi-tool 10 within the aforesaid first diameter opening formed at the first end 112 of the elongate cutout portion 110 on the back surface 104 of attachment member 100. The user then advances the multi-tool 10 along direction "H" such that the V-shaped body portion 106 of belt attachment apparatus 100 slidably receives within the aforesaid corresponding V-shaped channel 80 formed on the back surface of multi-tool 10 (FIGS. 5A and 5C). This sliding movement is continued until belt clipping member 90 abuts against the second end 114 of cutout portion 110 formed on the belt attachment apparatus 100. As mentioned above, it is noted belt clipping member 90 is slidably retained in cutout portion 110 since cutout portion 110 has a width larger than the first end 91 of belt clipping member 90 but smaller than the second end 93 of belt clipping member 90. Hereinafter, as shown in FIGS. 7B, 7D and 8A-D, multi-tool 10 is detachably engaged with belt attachment apparatus 100.

Figure 7C:
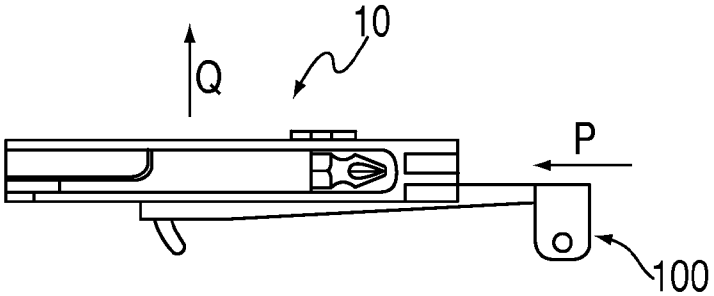
FIGS. 7A-D are elevational views of an illustrated embodiment of the multi-function tool assembly depicting detachable engagement of the multi-function tool with the belt attachment apparatus, specifically, 7A and B are rear elevational views and FIGS. 7D and C are side elevational views.
Figure 7A:
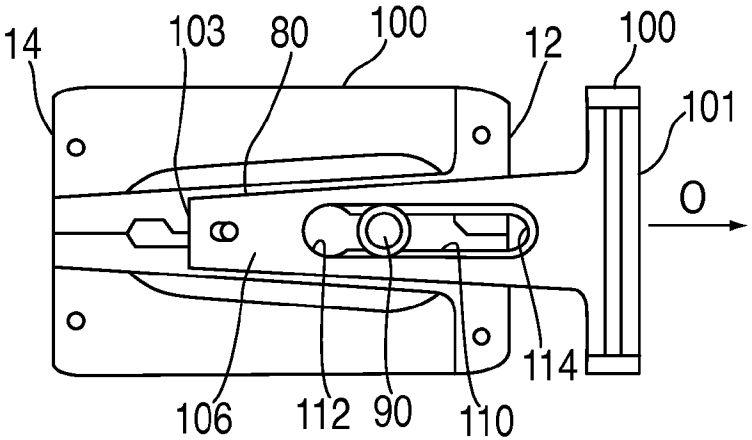
Figure 7D:
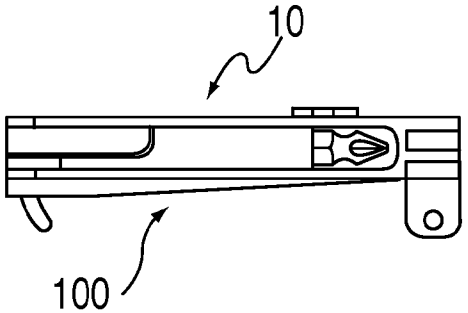
Figure 7B:
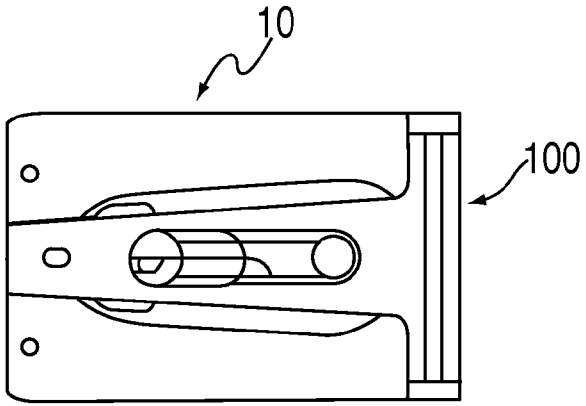
Figure 8C:
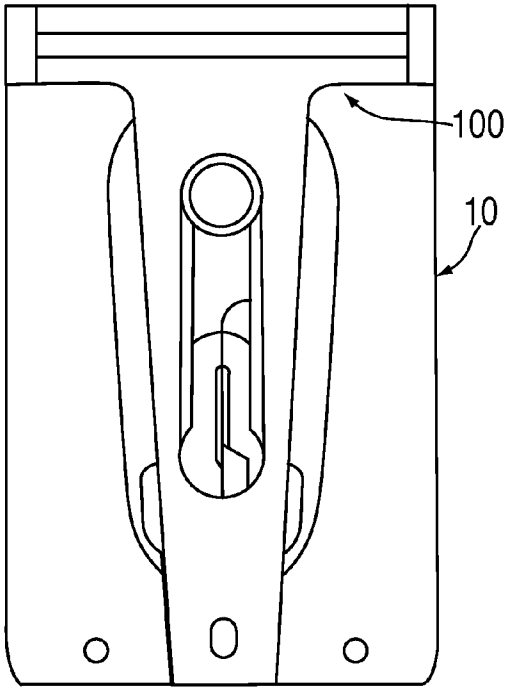
FIGS. 8A-E are elevational views of the multi-function tool assembly, specifically, 8A is a top elevational view, 8B is a side elevational view, 8C is a rear elevational view, 8D is a first end elevational view and 8*e* is a second end elevational view.
Figure 8B:
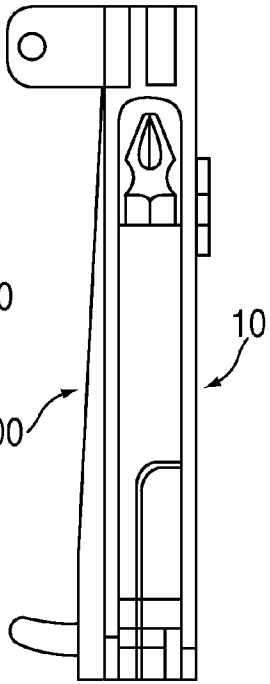
Figure 8A:
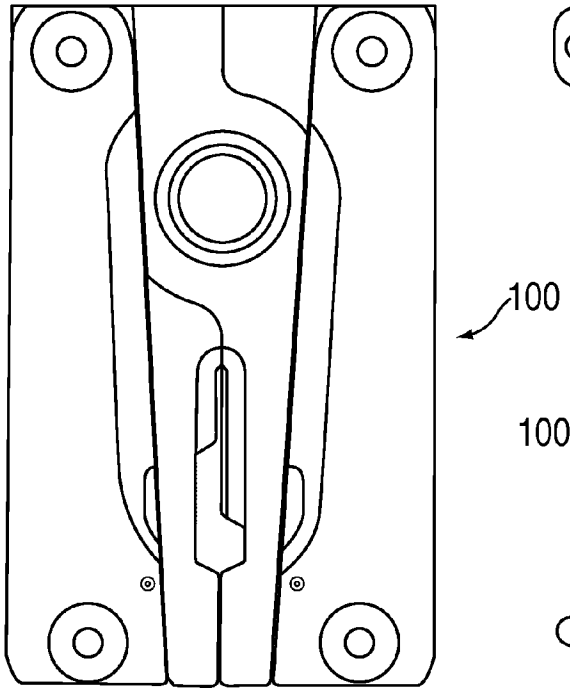
Figure 8E:
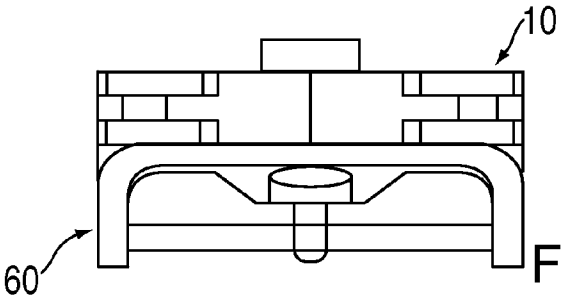
Figure 8D:
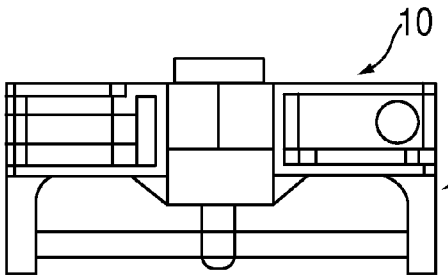
Figure 9A:
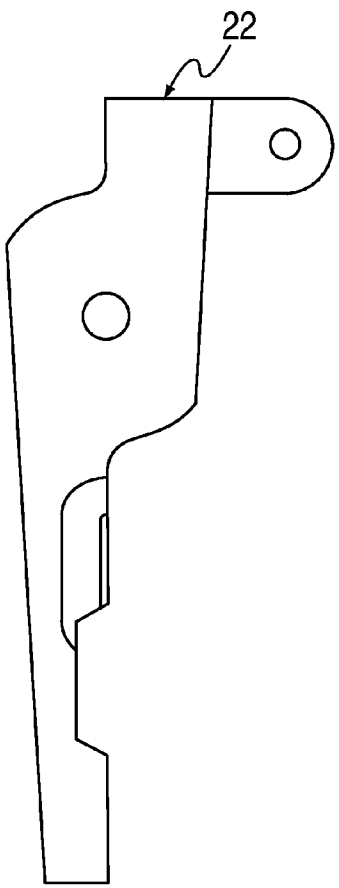
FIGS. 9A-F are elevational views of a first elongate jaw member, specifically, 9A is a rear elevational view, 9B is a front elevational view, 9C is a right side elevational view, 9D is a left side elevational view, 9E is a first end elevational view and 9F is a second end elevational view.
Figure 9C:
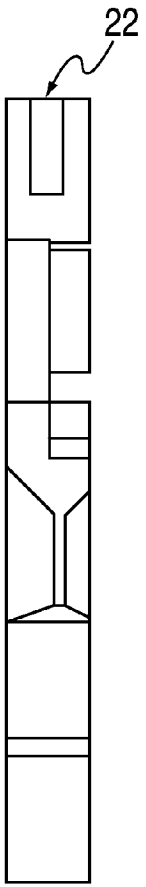
Figure 9D:
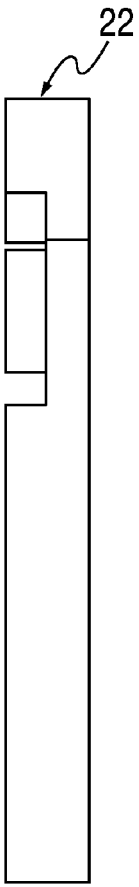
Figure 9B:
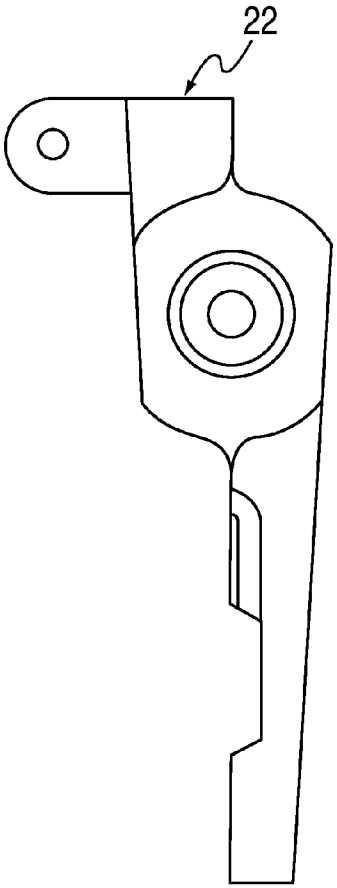
Figure 9E:
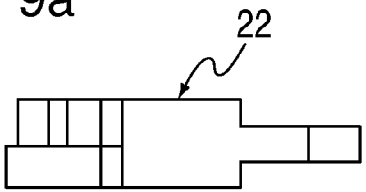
Figure 9F:
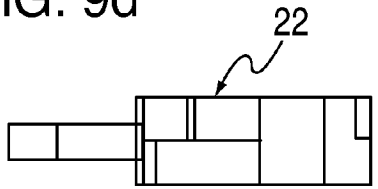
Figure 11D:
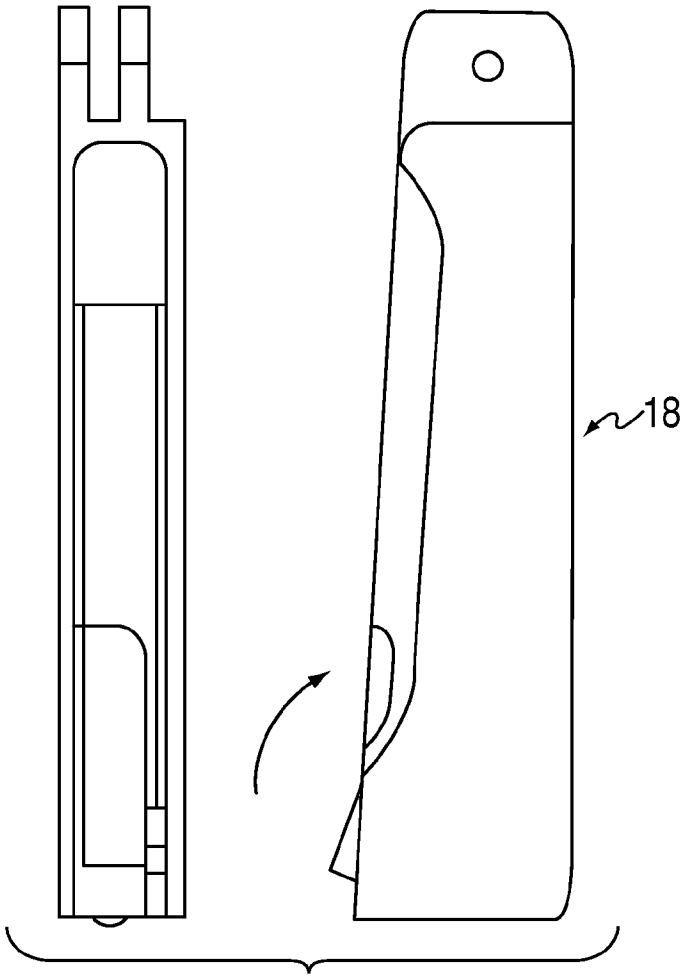
FIGS. 11A-D are elevational views depicting a handle member of the multi-function tool of FIG. 1, specifically, 11A is a top elevational view, 11B is a first side elevational view, 11C is a second side elevational view and 11D is a bottom elevational view.
Figure 11C:
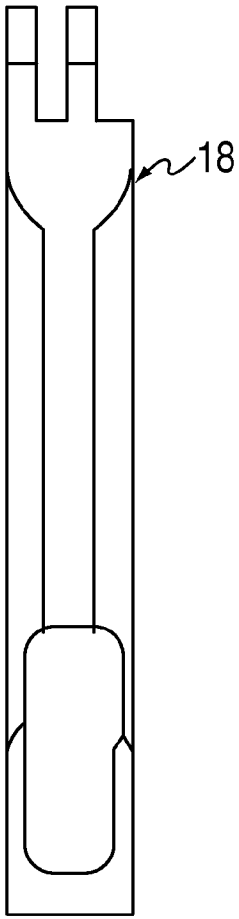
Figure 11B:
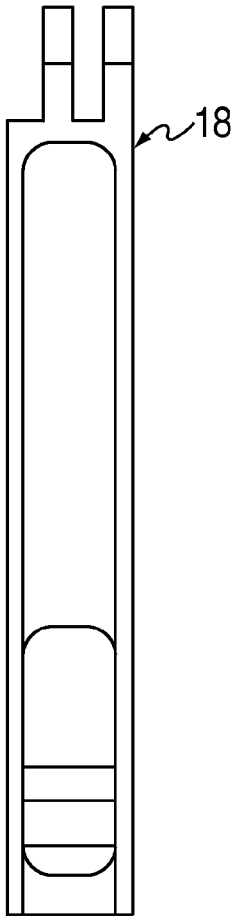
Figure 11A:
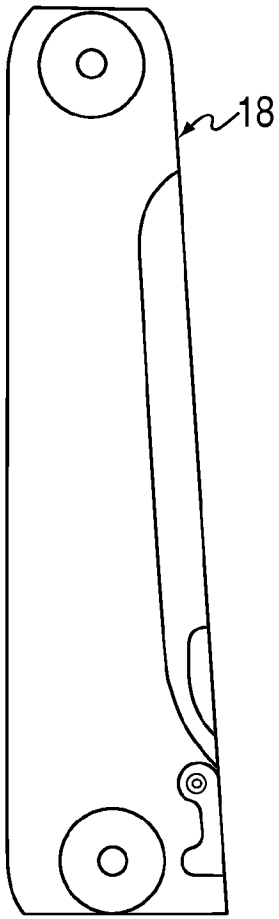

With primary reference now to FIG. 7C, when a user desires to detach multi-tool 10 from belt attachment apparatus 100, the user slides multi-tool 10 in the direction of arrow "P" until clipping member 90 advances toward the first end 112 of cutout portion 110 (FIG. 7*a*) having a diameter larger than that of clipping member 90. The user in then enabled to advance multi-tool 10 in the direction of arrow "Q" to detach multi-tool 10 from belt attachment apparatus 100.

It is to be appreciated the aforesaid procedure for attaching and detaching multi-tool 10 with belt attachment apparatus

100 can be performed with belt attachment apparatus 100 either attached or detached from a user's belt. And similarly, belt attachment apparatus 100 can be attached to a user's belt with or without the multi-function tool 10 attached thereto.

Although illustrated embodiments of the present invention has been described, it should be understood that various changes, substitutions, and alterations can be made by one of ordinary skill in the art without departing from the scope of the present invention.

What is claimed is:

1. An apparatus configured to couple with a user's belt for detachably engaging a multi-function tool, said apparatus comprising:

an elongate body member having opposing first and second ends;

an upstanding boss member provided in close proximity to said second end of said elongate body member configured to receive within a belt hole on a user's belt;

an elongate rod member extending substantially parallel from said second end of said elongate body member and spaced therefrom to receive a user's belt strap therebetween; and engagement structure provided on said elongate body member configured to detachably engage said multi-function tool, wherein said multi-function tool includes opposing front and rear surfaces with said rear surface including a channel portion configured to slidably receive at least a portion of said elongate body member of said apparatus wherein said belt clipping member is disposed in said channel portion.

2. An apparatus configured to couple with a user's belt for detachably engaging a multi-function tool as recited in claim 1, wherein said elongate body member is T-shaped such that said second end of said elongate body member includes a second elongate body member wherein each opposing end of said second elongate body member includes upstanding flange members supporting said elongate rod member.

3. An apparatus configured to couple with a user's belt for detachably engaging a multi-function tool as recited in claim 1, wherein said engagement structure provided on said elongate body member includes an elongate cutout configured to slidably receive a clipping member extending outwardly from said multi-function tool.

4. An apparatus configured to couple with a user's belt for detachably engaging a multi-function tool as recited in claim 1, wherein said multi-function tool is moveable between an open position and a closed position and has opposing front and rear surfaces, said multi-function tool includes:

a jaw-type tool having first and second elongate jaw members interconnected with each other by a pivot pin assembly, first and second handle members pivotally connected respectively to said first and second elongate handle members wherein when said multi-function tool is in said closed position, said first and second elongate jaw members are substantially parallel and adjacent to one another and said handle members are substantially parallel and spaced apart from one another at a distance approximately equal to the width of said parallel and adjacent said first and second elongate jaw members.

5. An apparatus configured to couple with a user's belt for detachably engaging with a multi-function tool as recited in claim 4, wherein said channel on said rear surface of said multi-function tool is defined between said spaced distance between said first and second handle members when said multi-function tool is positioned in said closed position.

6. An apparatus configured to couple with a user's belt for detachably engaging with a multi-function tool as recited in claim 5, wherein said pivot pin assembly includes said clipping member extending outwardly from said channel.

7. An apparatus configured to couple with a user's belt for detachably engaging with a multi-function tool as recited in claim 5, wherein said channel is V-shaped.

* * * * *